United States Patent [19]

Schirtzinger

[11] 4,005,666

[45] Feb. 1, 1977

[54] FLUID VACUUM RELEASE FOR ICE CUTTING SYSTEMS

[75] Inventor: Joseph F. Schirtzinger, Pasadena, Calif.

[73] Assignee: Sea-Log Corporation, Pasadena, Calif.

[22] Filed: June 23, 1975

[21] Appl. No.: 589,411

Related U.S. Application Data

[63] Continuation of Ser. No. 458,905, April 8, 1974, abandoned.

[52] U.S. Cl. ..... 114/42; 299/24

[51] Int. Cl.[2] ..... B63B 35/12

[58] Field of Search ..... 114/.5 D, 40–42; 61/1 R, 46.5; 299/24, 25

[56] References Cited

UNITED STATES PATENTS

| | | | |
|---|---|---|---|
| 3,335,686 | 8/1967 | Pontbriand et al. | 114/42 |
| 3,672,175 | 6/1972 | Mason | 114/41 |
| 3,678,873 | 7/1972 | Bennett | 114/42 |
| 3,693,360 | 9/1972 | Holder | 114/40 |

FOREIGN PATENTS OR APPLICATIONS

| | | | |
|---|---|---|---|
| 20,536 | 8/1901 | United Kingdom | 114/42 |

*Primary Examiner*—Trygve M. Blix
*Assistant Examiner*—Stuart M. Goldstein
*Attorney, Agent, or Firm*—Christie, Parker & Hale

[57] ABSTRACT

There is described a comminuting type ice cutter for use with vessels operating in ice-covered waters. Fluid, such as water or air, is injected into the region of each cutter edge to break the partial vacuum which is created at the cleavage interface of the ice fragments as they are broken away from the body of ice by the cutting or wedging action of the cutters. The fluid is introduced by passages extending through the cutter blades and opening adjacent the cutter edges. Alternatively the fluid may be forced into the cutting region by separate jets which may be either stationary or may rotate with the blades.

5 Claims, 5 Drawing Figures

FLUID VACUUM RELEASE FOR ICE CUTTING SYSTEMS

This is a continuation of application Ser. No. 458,905, filed Apr. 8, 1974, now abandoned.

FIELD OF THE INVENTION

This invention relates to ice-cutting apparatus, and more particularly, is concerned with a comminuting ice-cutter mechanism for vessels operating in arctic waters.

BACKGROUND OF THE INVENTION

With the increased interest in utilizing oil, gas and other resources in the arctic regions of the earth, there has developed a need for improved equipment for operating in ice-covered waters. For example, in Patent No. 3,768,428 there is described a marine vessel with rotary type ice-chipping equipment mounted on the bow of the vessel for cutting a channel through the ice. In such an arrangement, rotating cutter blades shear off or chip away fragments of ice from the ice sheet at relatively high speed to form an open channel through the ice sheet.

Studies of the shearing action taking place as the cutter blades are driven through the ice to cut away the chips and larger pieces of ice from the face of the ice sheet indicate that the cutting action involves forming a fracture ahead of the cutting edge, followed by a wedging apart of the ice along the fracture to separate the ice chips from the ice sheet. The separation of the ice along the fracture by the wedging action of the high speed cutter momentarily produces a void into which water or air must move to equalize the pressure with the surrounding ambient condition. Thus a pressure drop exists which tends to resist the separation of the ice particles along the cleavage. It has been found that a substantial amount of energy is dissipated by the cutters in overcoming the result of this partial vacuum effect produced at the moment the cleavage takes place between each particle of ice as it is removed from the ice sheet by the cutters.

SUMMARY OF THE INVENTION

The present invention provides a more efficient ice cutter of the comminuting type. This is accomplished by providing a mechanism for more rapidly equalizing the pressure at the point of cleavage between the ice being removed by the wedging action of a cutter and the ice sheet. This mechanism utilizes means for injecting fluid, such as water or air under pressure, at the point of cleavage from behind the cutter so as to dissipate the partial vacuum and change it into a positive pressure which aids the separation and removal of the chips by the cutters. This is accomplished, in brief, by providing fluid passages through the cutters which open adjacent the cutting edge of the cutters, and providing a flow of fluid under pressure through the passages for discharge into the space ahead of the cutters as the move through the ice.

BRIEF DESCRIPTION OF THE DRAWINGS

For a more complete understanding of the invention, reference should be had to the accompanying drawings, wherein.

DETAILED DESCRIPTION

Figure 2:
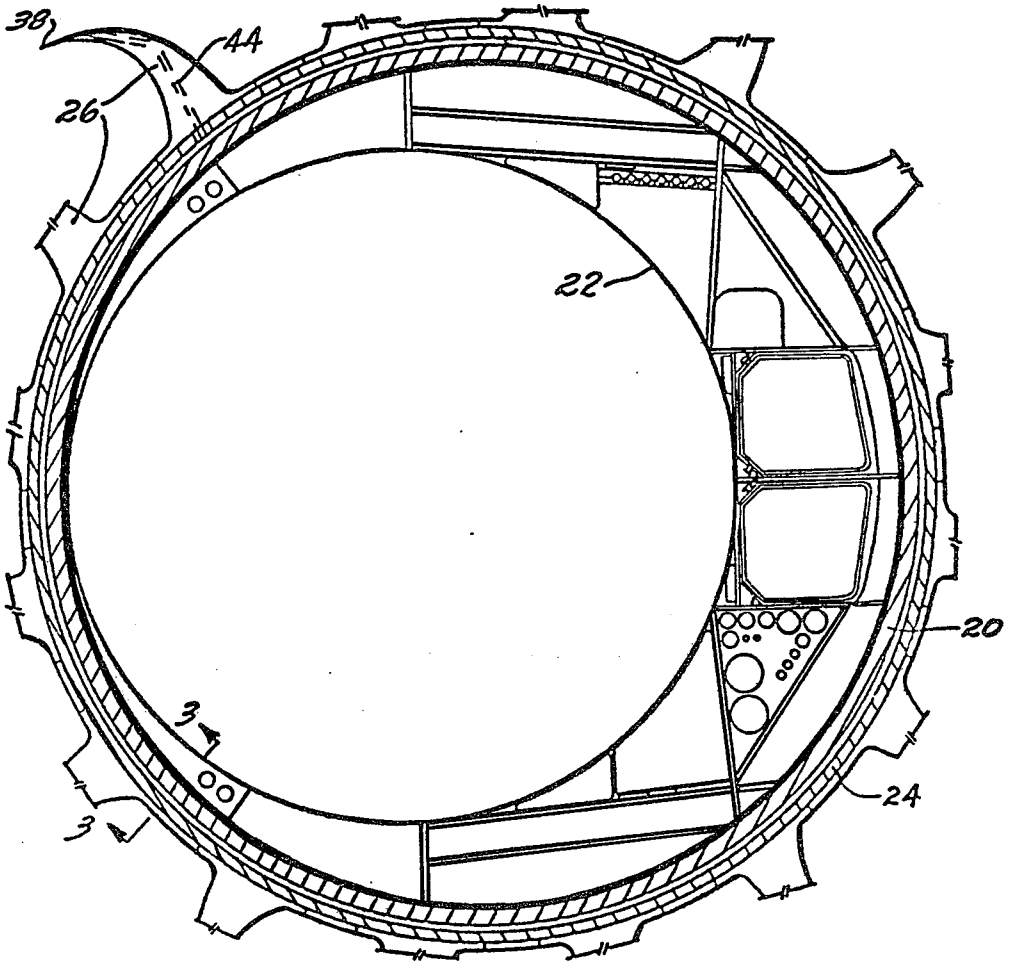
FIG. 2 is a cross-sectional view taken substantially on the line 2—2 of FIG. 1.
Figure 1:
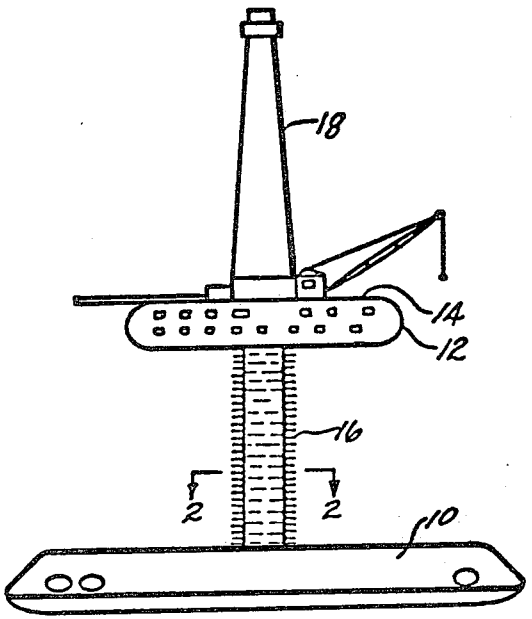
FIG. 1 is an elevational view of a monopod drilling platform incorporating an ice cutter.

In copending application Ser. No. 459029, and now Pat. No. 3894504, filed Apr. 8, 1974, entitled "Ice Cutter for Monopod Drilling Platform", assigned to the same assignee as the present invention, there is described in detail a drilling platform of the type shown in FIG. 1. The drilling platform includes a base 10 in the form of a hull constructed of bulkheads and outer plates providing a substantially watertight structure which may be ballasted to rest on the sea bottom at the drilling location or which may be sufficiently buoyant to float beneath the surface as a semi-submersible. A superstructure 12 providing an upper drilling deck 14 is supported above the water surface from the base 10 by a single vertical column indicated generally at 16. Drilling is accomplished from the drilling deck 14 down through the column and base into the sea floor by means of conventional drilling equipment including a drilling derrick 18 mounted on the drilling deck 14. As shown in the cross-sectional view of FIG. 2, the column consists of a outer stationary cylindrical shell 20 which is rigidly attached at its lower end to the bottom of the base 10. Inside the column 16 is a cylindrical casing 22 through which access to the ocean floor from the drilling deck is provided. The opening through the casing is referred to as the "moon pool". The casing 22 is preferably offset from the outer stationary cylinder 20 to provide a larger working space for men and equipment between the drilling deck and the subsurface base.

Surrounding the outside of the cylinder 20 and concentric therewith, is a cylindrical sleeve 24. The sleeve 24 is rotatably supported and driven from the upper superstructure 12 to permit continuous rotation of the sleeve 24 around the outside of the cylinder 20. Individual cutter arms 26 are secured to the outer surface of the sleeve 24. The cutter arms are positioned around the complete circumference of the sleeve 24 and are positioned vertically substantially the full length of the column 16.

Figure 3:
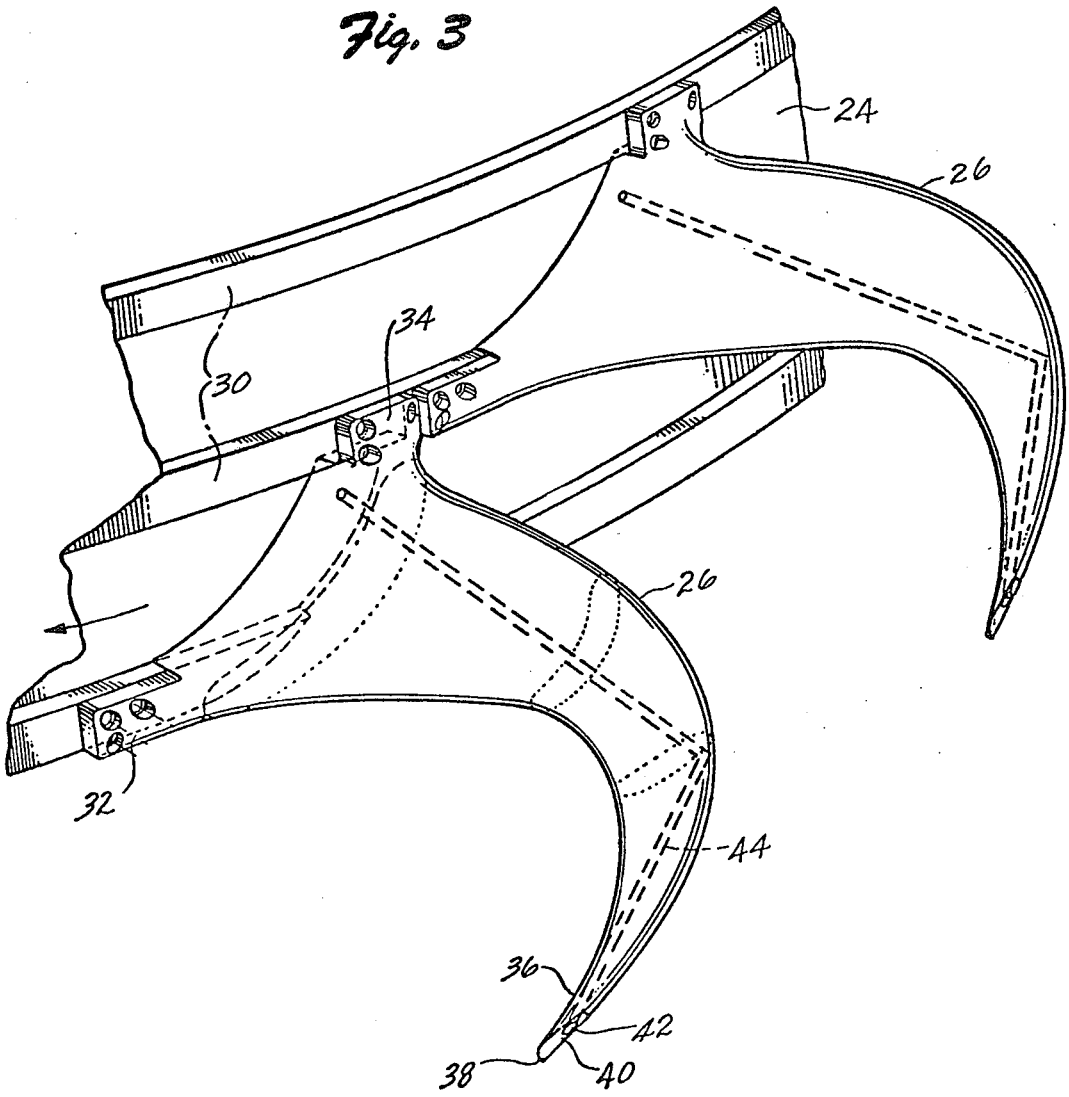
FIG. 3 is a perspective view showing details of the cutter arms.

Referring to FIG. 3, the individual cutter arms 26 are shown in more detail. The cutter arms are forged or otherwise shaped of high-tensile strength material with a base portion 28 which rests against the outer surface of the sleeve 24. The sleeve 24 is provided with a plurality of axially spaced ribs 30. The base 28 of the arm 26 extends between two adjacent ribs. Opposite ends of the base 28 terminate in flanges 32 and 34 which are bolted or otherwise anchored respectively to two adjacent ribs 30 of the sleeve 24.

The arms extend radially outwardly from the base 28, the outer end of the arms 26 curving in an arc so that the outer end 36 is almost tangential to the circular path of movement of the cutter tip. The end 36 is formed with a sharp cutting edge 38. The wedge-shaped cutting edge 38 is formed by a flat surface 40 machined on the outer periphery of the tip 36 of the arm 26. Thus as the sleeve 24 is rotated about a vertical axis in the direction indicated by the arrow in FIG. 3, the cutting edge 38 operates to fracture and dislodge large chunks of ice from the surrounding ice sheet.

As pieces of ice are dislodged by the wedging action of the tip 36 when the edge 38 penetrates into the ice sheet, a void is momentarily produced between the cleavage surfaces. There is therefore a pressure drop existing momentarily which tends to resist the separation of a piece of ice from the ice sheet along the cleavage. Air or water must flow in behind the piece of ice to equalize the pressure between the cleavage surfaces. In order to equalize the pressure more rapidly and thereby reduce the force required to dislodge the pieces of ice by the cutter arms, fluid under pressure is directed at the point where the ice fracture is formed, namely, at the cutting edge 38. To this end, in the embodiment shown in FIG. 3, fluid under pressure is discharged through an opening 42 in the surface 40. The opening 42 is formed by a passage 44 in the cutter arms 26 which extends from the opening 42 through the arm to the base 28. Preferably the opening in the base 28 communicates with an opening through the sleeve 24 so that, by pressuring the annular space between the inside of the sleeve 24 and the supporting column, water is forced out through the passages 44 on those cutter arms below the water level while air is forced out through those cutter arms positioned above the water level. Suitable sealing means, such as the nylon bearings at either end of the sleeve 24, described in the above-identified copending application, close off the annular space at either end of the sleeve permitting the annular space to be maintained at an elevated pressure by pumping water or air into the annular space. For ease of manufacture, it will be noted that the passage 44 is formed of two straight sections, permitting the bore to be formed by conventional machine drilling techniques.

Figure 4:
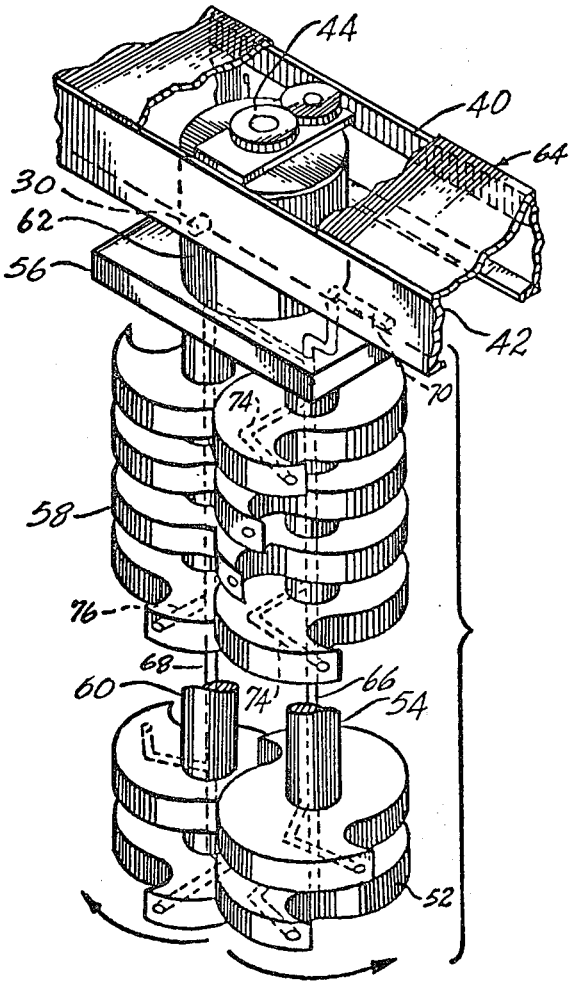
FIG. 4 shows an alternative embodiment of the invention;.

Referring to FIG. 4 there is shown an alternative type of ice cutter such as described in U.S. Pat. No. 3,768,428, assigned to the same assignee as the present invention. In this cutter arrangement a pair of oppositely rotating interleaved cutters are provided. Thus a plurality of spaced rotary cutters 52 are mounted on a shaft 54 and are interleaved with a group of rotary cutters 58 mounted on a shaft 60. The two counterrotating shafts 54 and 58 are driven from a motor 62 through a transmission drive 56. The entire cutter assembly is supported on a frame member 64 in a manner described in detail in the above-identified patent.

To provide the features of the present invention, the shafts 54 and 60 are provided with axially extending bores 66 and 68, respectively. These central bores are connected to a conduit 78 from a source of water under pressure (not shown) through conventional rotary couplings on the ends of the shafts 66 and 68. Each of the cutters 52 and 58 in turn is provided with internal passages, such as indicated at 74 and 76, the passages leading from the central bores 66 and 68, respectively, to openings on the outer periphery of the cutters 52 and 58 immediately adjacent the cutting edges of the cutters. Thus water (or air) under pressure connected to the conduit 70 is discharged at the point of cleavage and separation of the ice particles by the respective cutters.

Figure 5:
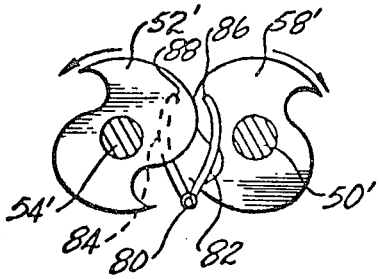
FIG. 5 is a top view of the cutter arrangement of FIG. 4 with a modified arrangement for injecting fluid into the cutting region.

An alternative arrangement is shown in FIG. 5 in which cutters 52' and 58' are interleaved and rotated by shafts 54' and 60', respectively, in the same manner as described above in connection with FIG. 4. However, in place of the fluid discharge at the cutting edges of each of the cutters, pressurized fluid is discharged adjacent the ice engaging region of the cutters by means of a vertically extending pipe 80 adapted to be connected at a pressurized fluid source (not shown), the pipe serving as a manifold having a plurality of discharge pipes, two of which are indicated at 82 and 84, respectively, which project radially into the openings between the shafts 54' amd 60' formed by the interleaved cutters. These discharge pipes 82 and 84 terminate in nozzles 86 and 88, respectively, for directing fluid tangentially along the outer perimeter of the respective cutters 52' and 58'. One such discharge pipe and nozzle is provided for each of the vertically spaced interleaved cutters. The vertical pipe 80 is connected to a suitable source of fluid, such as water or air, under high pressure. The discharge of fluid under pressure adjacent each of the cutters where the cutting edge engages the ice permits the partial vacuum at the cleavage interface produced by the cutting edges moving through the ice to be dissipated more rapidly, increasing the cutting efficiency.

What is claimed is:

1. A comminuting ice cutter comprising a plurality of rotating cutter elements, the cutter elements having a plurality of cutting edges spaced circumferentially around a common axis and adapted to engage ice and dislodge pieces of ice by impacting action, drive means rotating the cutter elements continuously in a direction around said common axis for applying high velocity impacts on the adjacent ice, and means for directing fluid under pressure at the interface between each of the cutting edges of the cutter elements and the ice when it comes in contact with the cutting edges, said fluid means by fluid ejection dissipating the partial vacuum resulting from ice cleavage and changing it into a positive pressure which aids the separation and removal of the chips by the cutter elements.

2. Apparatus of claim 1 wherein the fluid is air.

3. Apparatus of claim 2 wherein the means directing the air includes nozzle means movable with each cutter for directing the air at the moving cutting edge of each cutter.

4. Apparatus of claim 2 wherein the means directing the air includes fixed nozzle means for directing air at the point of impact of each cutter with the ice.

5. A comminuting ice cutter comprising a plurality of rotating cutter elements, the cutter elements having a plurality of cutting edges spaced circumferentially around a common axis and adapted to engage ice and dislodge pieces of ice by impacting action, drive means rotating the cutter elements continuously in a direction around said common axis for applying high velocity impacts on the adjacent ice, and means for directing fluid under pressure at the interface between each of the cutting edges of the cutter elements and the ice when it comes in contact with the cutting edges, the means directing the air including a passage through the cutter element opening adjacent the cutting edge, the air being released through the opening.

* * * * *